US006740609B1

(12) United States Patent
Peng et al.

(10) Patent No.: US 6,740,609 B1
(45) Date of Patent: May 25, 2004

(54) SOFT POLYPROPYLENE MELT SPUN NONWOVEN FABRIC

(75) Inventors: Fang Yi Peng, Nanhai (CN); Zhang Dao Hong, Nanhai (CN); Chen Kang Zhen, Nanhai (CN); Zhou Pei Qiong, Foshan (CN)

(73) Assignee: Polymer Group, Inc., North Charleston, SC (US)

( * ) Notice: Subject to any disclaimer, the term of this patent is extended or adjusted under 35 U.S.C. 154(b) by 108 days.

(21) Appl. No.: 09/638,341

(22) Filed: Aug. 15, 2000

(51) Int. Cl.[7] ..... D04H 5/00; D04H 1/06; D04H 3/16; C08L 5/20

(52) U.S. Cl. ..... 442/327; 442/301; 442/333; 442/359; 442/401; 524/232; 524/219

(58) Field of Search ..... 442/301, 327, 442/401, 359, 333; 524/232, 219; 428/373

(56) References Cited

U.S. PATENT DOCUMENTS

| | | | |
|---|---|---|---|
| 3,454,519 A | 7/1969 | Hulse et al. | |
| 4,041,203 A | 8/1977 | Brock et al. | |
| 5,033,172 A | 7/1991 | Harrington | |
| 5,244,724 A | 9/1993 | Antonacci et al. | |
| 5,733,635 A | 3/1998 | Terakawa et al. | |
| 5,810,954 A | 9/1998 | Jacobs et al. | |

FOREIGN PATENT DOCUMENTS

| | | | | |
|---|---|---|---|---|
| JP | 08-246232 | * | 9/1996 | ..... D01F/6/46 |

* cited by examiner

*Primary Examiner*—Terrel Morris
*Assistant Examiner*—Lynda M Salvatore
(74) *Attorney, Agent, or Firm*—Wood, Phillips, Katz, Clark & Mortimer

(57) ABSTRACT

A blend of fatty acid amides is incorporated into the polypropylene fibers of a thermally bonded, melt extruded nonwoven fabric to import softness to the fabric. The blend includes a greater amount of stearamide and a lesser amount of erucamide.

6 Claims, No Drawings

SOFT POLYPROPYLENE MELT SPUN NONWOVEN FABRIC

BACKGROUND

This invention relates to nonwoven fabrics and more particularly to fabrics made from thermoplastic polymers such as polypropylene.

In general, melt spinning involves the extrusion of molten polymer through a number of small orifices in a spinneret to form fibers or filaments. In the well-known spunbonding process, these filaments are drawn and then collected on a moving foraminous surface, such as a wire mesh conveyor belt. The web is then consolidated by some means, usually involving heat and pressure, such as thermal point bonding. A cohesive fabric of continuous filament fibers is thus provided.

A related process is the melt blown process, which also relies upon the extrusion of molten polymer through a number of orifices in a die. Here, the drawing; process involves hot, high velocity air, which significantly reduces the filament diameter and breaks the continuous filaments into so-called microfibers of varying length to diameter ratio.

Currently, many nonwoven manufacturing lines include at least two spunbond stations and optionally one or more meltblown stations in between. This enables the continuous production of a composite fabric consisting of discrete spunbond and meltblown layers. These fabrics are commonly called SMS, referring to a spunbond-meltblown-spunbond arrangement of layers Such webs are typically consolidated by thermal point bonding.

Polypropylene is used as the base resin for many commercial spunbond, meltblown and SMS fabrics. Such fabrics have a wide variety of end uses, including liners for sanitary articles, such as disposable diapers and feminine hygiene products and in protective apparel. In these applications, softness is a highly desirable attribute, due to intimate contact of the article with the skin of the user.

Improvements in tactile softness, also referred to as hand, have been approached in a number of ways. The use of polyethylene as the base resin produces a silky hand. However, these fabrics have greatly reduced abrasion resistance and tensile strength and are not suited to many of the standard applications. Further, polyethylene is more difficult to process than polypropylene and significant costs are incurred due to process inefficiencies. These issues are partially addressed by the bicomponent filaments, which provide two polymers in a single filament, where the polymers are strategically placed in the filament cross-section. Polypropylene-polyethylene or polyester-polyethylene bicomponent fibers are examples of this technology. Side-by-side and sheath-core filament geometries are familiar to those skilled in the art. However, special spinnerets and additional extruders are required for such spinning operations. Other operating inefficiencies also exist and the full softness benefits of the polyethylene component are not realized in fabrics produced from these filaments. Topical treatments which increase the slickness of the surface are known to provide a perception of tactile softness. Silicone and oleate treatments have been reported in the art. However, the oily feel of such treated fabrics is not appreciated by the market place. The use of melt additives is also known in the art Glycerol monostearate, and fatty acid esters are repeatedly cited in the art for having combined surface effects of hydrophilicity and tactile softness such as described in U.S. Pat. No. 5,244,724. However, the practical demonstration of actual improvements in tactile softness is not evident. Further, softness comfort for the wearer of a garment, such as a diaper, is a combination of attributes—requiring both tactile and ductile (bending ease) softness. With the exception of nonwoven fabrics produced from a polyethylene base resin, ductile softness improvements are not provided by the designs of the considered prior art. A mechanical approach to providing both tactile and ductile softness relies upon the production of very fine diameter filaments in the spunbond fabric. Here, the fiber diameters begin to approach the upper boundaries of the defined diameters for meltblown microfibers. This technology is discussed in U.S. Pat. Nos. 5,810,954 and 5,733,635. Such fabrics have recognizable benefits in softness, but the production inefficiencies are such that the fabrics are frequently not cost competitive in the market place.

In general, it is known to incorporate certain fatty acid amides into polypropylene melts to provide a durable surface lubricant to the resulting fibers or filaments as disclosed in U.S. Pat. No. 3,454,519. It has further been noted that such additives can render polyolefin fabrics more wettable, as described in U.S. Pat. No. 5,033,172, by way of example. Such amides are also known as antiblocking agents in the production of thermoplastic films and the prior art contains many citations of that application.

SUMMARY OF THE INVENTION

It has been discovered that very distinct tactile and ductile softness can be obtained in melt spun fabrics by the melt addition of a particular combination of fatty acid amides. The blend of fatty acid amides is provided comprising 25 to 40 percent erucamide and 60 to 75 percent stearamide. These amides are compounded into a polypropylene base resin and produced as concentrate pellets containing 1 to 15 percent total amide loading. The concentrate pellets are introduced into the extruder feed with the base polypropylene resin at a 2 to 10 percent letdown, with 3 to 6 percent preferred.

Upon extrusion into filaments or fibers, the resulting web is thermally point bonded to produce a fabric which is then wound into rolls. There is an appreciable improvement in softness without a negative impact on the physical properties of the fabric, such as tensile strength, or on the process efficiencies as compared to the same process without the use of the additive.

DETAILED DESCRIPTION

Processes for making nonwoven fabrics by melt extrusion of thermoplastic polymers are well known and suitable equipment is commercially available. In a spunbonding process, molten polymer is extruded under pressure through a large number of orifices in a plate known as a spinneret or die. The resulting filaments are quenched and drawn by any of a number of methods, such as slot draw systems, attenuator guns or Godet rolls. The filaments are collected as a loose web on a moving foraminous surface, such as a wire mesh conveyor belt. When more than one extruder is in line for the purpose of forming a multilayered fabric, the subsequent webs are collected upon the topmost surface of the previously formed web. The web is then consolidated by some means involving heat and pressure, preferably thermal point bonding for the present invention. Using this means, the web or layers of webs are passed between two hot metal rolls, one of which has an embossed pattern to achieve the desired degree of bonding, usually on the order of 15 to 35 percent If a layer or layers of meltblown microfibers are incorporated into the composite fabric to produce a SMS fabric, a standard meltblown process is also employed. Here the molten polymer is again extruded under pressure through orifices in a spinneret or die. High velocity air impinges upon the filaments as they exit the die. The polymer stream is thus rapidly quenched and attenuated. The energy of this step is such that the formed filaments are greatly reduced in diameter and are fractured so that fibers of finite length are produced. This differs from the spunbond process where the continuity of the filaments is preserved. The process to form either a single layer or a multilayer fabric is continuous, that is, the process steps are uninterrupted from extrusion of the filaments to form the first layer until the bonded web is wound into a roll. Methods for producing these types of fabrics are described in U.S. Pat. No. 4,041,203, incorporated herein by reference.

In accordance with the present invention, a particular blend of fatty acid amides is added to the raw polypropylene polymer prior to extrusion. A blend of stearamide and erucamide is prepared as a concentrate in a suitable polyolefin resin, such as Exxon 3445 polypropylene, at a level of one to 15 percent of the fatty acid amide blend by weight. The concentrate and resin are then produced as a pellet to facilitate mixing with the base polyolefin feedstock at the extruder.

The blend comprises from about 25 to 40 percent erucamide and from about 60 to 75 percent stearamide based on the total weight of the two additives, with about a 1:2 ratio preferred. The concentrate pellets are then added directly into the extruder with the neat polypropylene feedstock at a letdown of two to ten percent based on the total weight of the concentrate and the base resin combined, preferably four to six percent. The filaments or fibers thus produced contain at least about 0.02 percent the amide blend, with 0.2–1.0 percent preferred. The combination of the fatty acid amide additives and the polypropylene resin were processed without measurable detrimental effects on the manufacturing efficiencies or uniform production of the fabric. The resultant webs are thermally bonded to produce the final fabric.

In addition, the ductile softness, described herein as bending resistance, of the consolidated fabric will be less than about 0.62 gram per gram of fabric as determined by the Handle-O-Meter test described in the examples. This value represents about a ten percent improvement in ductile softness of the fabrics of the invention as compared to similarly prepared fabrics without the addition of the amide blend as described. This value is appreciated in the market as a factor of comfort, such that wrinkles and designed folds of the fabric in the garments will not be stiff and therefore coarse and abrasive to the skin. When combined with the tactile softness improvements discussed in the examples, the fabrics of the invention provide a recognizable improvement over fabrics currently available for the expected end use applications, such as absorbent articles and protective apparel.

EXAMPLES

Comparative samples were produced using a standard manufacturing line and Exxon 3445 polypropylene or Dow polyethylene, without the additive. Comparative example 1 was a two-layered spunbond polyethylene fabric at 27 grams per square meter (gsm) basis weight. Comparative example 2 was a 15 gsm two layered spunbond polypropylene. Comparative example 3 was a 15 gsm polypropylene SMS fabric. Example fabrics of the invention were produced on the same equipment as comparative examples 2 and 3. These fabrics were produced with a four to six percent letdown of the concentrate pellets containing the additives. Example 1 was a 15 gsm two layered spunbond polypropylene. Example 2 was a 15 gsm polypropylene SMS.

Tensile strength tests were conducted on spunbond and SMS fabrics produced according to this invention. These results were compared to results for fabrics similarly produced without the additive package. These tests revealed that there is no significant impact on the strength properties of the fabrics of this invention.

Tactile softness of the fabrics were evaluated by ten panelists in a blind test who ranked fabrics in the test set on a comparative scale of 1 to 8, where 1 was the softest fabric and 8 was the harshest hand by comparison. Comparative examples and example fabrics of the invention were evaluated in the same test set. Tactile softness was rated by rubbing the fabric between the fingertips (Softness) and by stroking the fabric surface with the fingertips (Smoothness). The results of these evaluations are presented in Table I. Note that, as expected, the polyethylene spunbond sample was rated the softest, with the example of the invention receiving a rating of 2, although the polyethylene sample did not rate well on smoothness.

Ductile softness (flexural resistance or bending resistance) was evaluated using a Handle-O-Meter tester available from Thwing-Albert. Fabrics were cut into 4"×4" test samples, with the MD and CD directions noted. The slot width on the test surface was set at 0.375". Samples were placed on the test surface so that the slot was centered from the edges and the noted test direction, MD or CD, was perpendicular to the slot. The penetration beam was activated and the digital reading of the bending resistance was recorded in grams, where higher values indicate increased bending resistance and less ductile softness. Each sample was then rotated 90° for another reading. Then the sample was turned over and two additional readings at 90° rotations were taken. In this manner, each test sample produced four readings. Each fabric sample was tested in duplicate. The data presented in Table II includes the average of the readings for each example fabric tested as well as a value normalized for fabric basis weight. Fabrics of the invention were noted to have substantially lower values than the comparative samples. Example 1 has a value approximately 50% less than the comparable all polypropylene comparative. For the SMS fabrics, the difference was an approximately 15% improvement in ductile softness for the fabrics of the invention.

TABLE I

Tactile Softness Evaluation

| Examples | type | Evaluation | |
|---|---|---|---|
| | | Softness | Smoothness |
| Comp. Ex 1 | SS | 1 | 8 |
| Comp. Ex 2 | SS | 5 | 7 |
| Comp. Ex. 3 | SMS | 8 | 7 |
| Example 1 | SS | 2 | 5 |
| Example 2 | SMS | 6 | 3 |

Rating scale = 1–8, where 1 is softest

TABLE II

| Examples | Bending Resistance Average, g | Bending Resistance per unit Basis Weight, g/gsm |
|---|---|---|
| Comp. Ex. 1 | 7.09 | 0.26 |
| Comp. Ex. 2 | 10.12 | 0.67 |
| Comp Ex. 3 | 10.6 | 0.71 |
| Example 1 | 5.08 | 0.33 |
| Example 2 | 9.08 | 0.61 |

What is claimed is:

1. A soft, melt extruded polypropylene nonwoven fabric, said fabric comprising spunbond thermally bonded polypropylene filaments which thermally bonds individual ones of said filaments to each other and consolidates said fabric containing as a melt additive a blend of fatty acid amides in said polypropylene in an amount of at least 0.02%, said blend comprising stearamide and erucamide, where the amount of stearamide is greater than the amount of erucamide, where the bending resistance of the fabric is less than about 0.62 grams per gram of fabric.

2. The fabric of claim 1 where the blend comprises 25 to 40 percent erucamide.

3. The fabric of claim 1 where the blend comprises 60 to 75 percent stearamide.

4. The fabric of claim 1 used as a topsheet component in an absorbent article.

5. The fabric of claim 1 used as a skin-contacting component in a protective apparel article.

6. The fabric of claim 1 where the blend comprises from about 2.0 to about 1.0 of the weight of the fabric.

* * * * *